US008985899B2

(12) United States Patent
McIntyre

(10) Patent No.: US 8,985,899 B2
(45) Date of Patent: Mar. 24, 2015

(54) SYSTEM AND METHOD OF WATER FLOW QUANTITY EQUALIZATION

(71) Applicant: William Charles McIntyre, Broomfield, CO (US)

(72) Inventor: William Charles McIntyre, Broomfield, CO (US)

(73) Assignee: William Charles McIntyre, Broomfield, CO (US)

( * ) Notice: Subject to any disclaimer, the term of this patent is extended or adjusted under 35 U.S.C. 154(b) by 0 days.

(21) Appl. No.: 13/694,373

(22) Filed: Nov. 27, 2012

(65) Prior Publication Data

US 2014/0147211 A1 May 29, 2014

(51) Int. Cl.
*E02B 3/02* (2006.01)
*E02B 3/00* (2006.01)

(52) U.S. Cl.
CPC ..... *E02B 3/00* (2013.01)
USPC ..... 405/80

(58) Field of Classification Search
CPC ..... E02B 3/02; E02B 13/00; E02B 3/00
USPC ..... 405/39, 51, 80
See application file for complete search history.

(56) References Cited

U.S. PATENT DOCUMENTS

| | | | | | |
|---|---|---|---|---|---|
| 1,768,310 | A * | 6/1930 | Erickson | 405/51 |
| 3,061,276 | A * | 10/1962 | Homan | 165/260 |
| 3,461,674 | A * | 8/1969 | Pye et al. | 405/74 |
| 3,667,234 | A * | 6/1972 | De Lizasoain | 405/80 |
| 3,733,830 | A * | 5/1973 | Jacobs | 405/73 |
| 4,000,620 | A * | 1/1977 | Burge | 405/43 |
| 4,522,534 | A * | 6/1985 | Wakamori et al. | 405/37 |
| 5,487,621 | A * | 1/1996 | Takada et al. | 405/80 |
| 5,613,803 | A * | 3/1997 | Parrish | 405/92 |
| 5,733,065 | A * | 3/1998 | Yamada et al. | 405/52 |
| 5,839,852 | A * | 11/1998 | Mattson | 405/36 |
| 7,025,532 | B2 * | 4/2006 | Suazo et al. | 405/36 |
| 7,797,143 | B2 * | 9/2010 | Belcher et al. | 703/9 |
| 7,820,054 | B2 * | 10/2010 | Hastings et al. | 210/702 |
| 8,602,687 | B2 * | 12/2013 | Hubbell, Jr. | 405/107 |
| 2006/0072971 | A1 * | 4/2006 | Suazo et al. | 405/119 |
| 2012/0315092 | A1 * | 12/2012 | Quaglino et al. | 405/80 |

* cited by examiner

*Primary Examiner* — Benjamin Fiorello

(57) ABSTRACT

A method of removing water from a water body, such as a stream or river, upstream from an existing authorized stream diversion, while simultaneously, adding water (not native to the watershed), downstream of the new authorized diversion location, in a manner to not change or influence, the flow quantity or availability, historically passing a point downstream of the new location of non-tributary water introduced into the stream or river.

8 Claims, 1 Drawing Sheet

SYSTEM AND METHOD OF WATER FLOW QUANTITY EQUALIZATION

CROSS-REFERENCE TO RELATED APPLICATION

Not Applicable

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISC APPENDIX

Not Applicable

BACKGROUND OF THE INVENTION

This invention pertains to water fluid mechanics, physical sites of diversion, and physical sites of downstream water fluid replacement. Water can either be underground, hereinafter referred to as groundwater, or surface water, hereinafter referred to as streams or rivers, whether navigable or not. Water, in the fluid state, can also be transported in, for example, but not limited to pipelines, open channels, by train, or truck. There may be occasions when it is desirable to divert water upstream from an authorized existing stream diversion location, due to a higher water quality or a newly constructed water storage vessel, (such as a reservoir), other water storage mechanism, transfer to a tributary of the original drainage basin, or other reason for a different place of usage for the water. The application of this invention will allow, without reduction in water flow quantity at a defined downstream location, while a simultaneous (depending on stream velocities which may require a delay in the replenishment water) diversion from the stream, at an upstream location of an authorized diversion at an equal or near equal quantity of water. This mechanism can only occur, when the fluid flow between the new upstream diversion location, and the location for the downstream fluid flow replacement, is not diminished in an amount that an intermediate diverter is legally entitled to divert historically.

BRIEF SUMMARY OF THE INVENTION

This invention is an application of fluid mechanics flow continuity, wherein an amount of water can be physically diverted, by various means, from a physical location, not limited to a surface stream, or pump station, or tributary channel, located adjacent to a stream, or river channel, at a new location upstream of an authorized diversion point(s), and at approximately the same time the same amount of water is introduced downstream of the new location, simultaneously or delayed, depending on the stream travel time, in order to maintain the quantity of water downstream of the replenishment or reintroduction site. The intent of this methodology is to maintain fluid mechanics flow continuity, downstream of the lower reintroduction location. This process may be referred to as a substitution or trade of water, between an upstream location and downstream location.

DETAILED DESCRIPTION OF THE INVENTION

Figure 1:
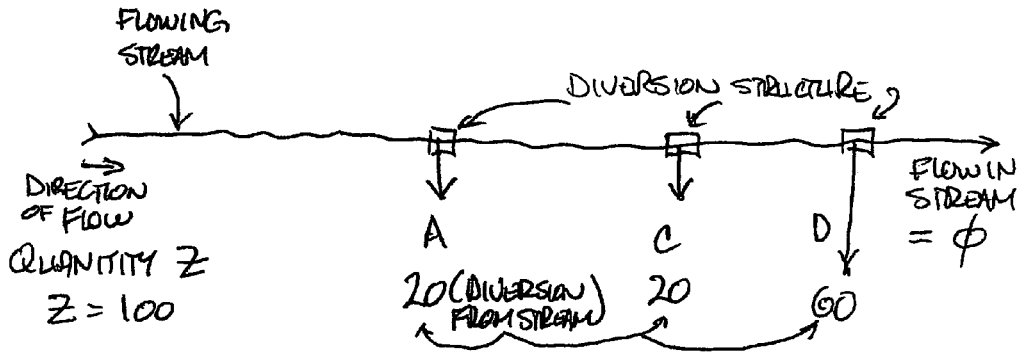
FIG. 1 shows a schematic of a river system with various diversions A, C, and D. The direction of flow is from left to right and the initial river flow quantity is Z. Let the flow Z=100,, the diversion (away from the river) at point A=20,, the diversion (away from the river) at C=20,, and the diversion (away from the river) at D=60. Therefore the flow quantity (the flow in the river) below D=100−, (20+20+60)=0.
Figure 2:
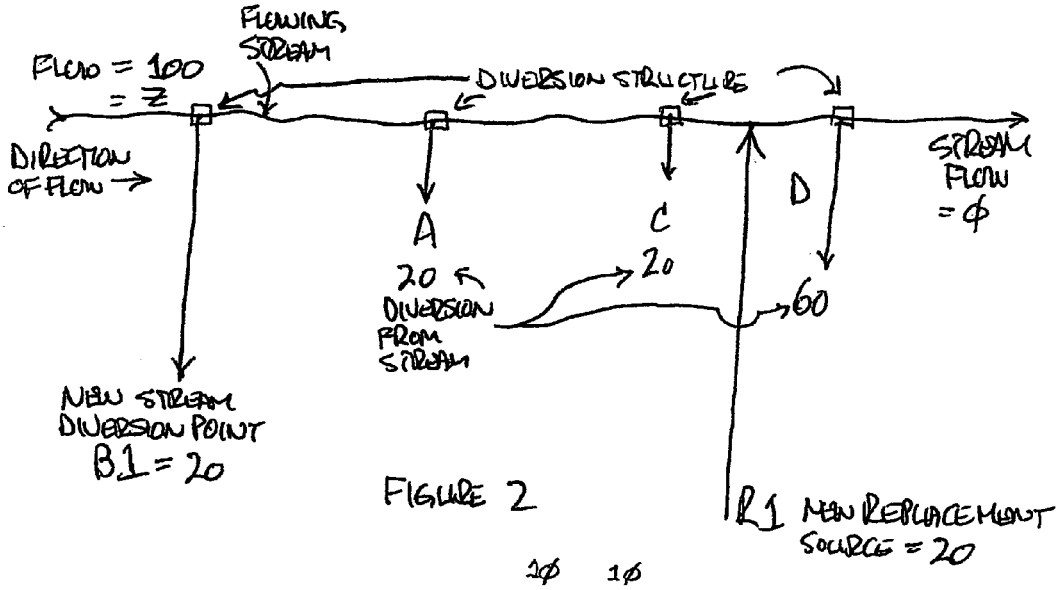
FIG. 2 shows a schematic where a trade or substitution of water is made at R1, due to the authorized diversion at B1. The river flow quantity Z does not change between FIGS. 1 and 2. The new replacement flow (flows into the river) quantity, R1, is not hydraulically connected to the river system with river flow quantity Z. This flow R1 is termed not hydraulically connected to the drainage basin (ie non-tributary). The flow quantity downstream of point D (which is equal to 0), remains unchanged between configurations depicted on FIGS. 1 and 2. Thus, this fluid flow process invention maintains flow continuity downstream of point D, while allowing a location modification of diversion locations upstream of point D. The unforeseen improvement in this invention is the introduction of a non-tributary (to the given drainage basin) water source to maintain the river fluid flow quantity and flow regime downstream of point D, while continuing the diversions at points A, C, and D. Examples of non-tributary water include water storage reservoirs, non-tributary well water, water pumped via pipeline from a non-tributary basin.

A new river or stream diversion is constructed at point B1 and the amount of flow is controlled by a recording device. A new stream inflow source at point R1 is constructed. This new non-tributary (aka foreign) water can be conveyed by pipeline, open channel, or other water conveyance device. The flow R1 is designed to mimic the diversions at point B1, such that at observation point D, no change in river or stream flow regime quantity is measurable. This new invention insures that historic flows (including flow quantities, and availability) at A, C, and D, are not changed due to the new upstream diversion located at point B1. There is no existing United States patent that involves or describes this water flow quantity equalization system and method.

What is claimed is:

1. A flow quantity equalization method comprising:

a flow of water through a waterway from an upstream higher elevation to a downstream lower elevation, wherein the flow of water through the waterway has an output volume of water flow;

reducing the flow of water through the waterway by at least one man-made water diversion structure that diverts water away from the waterway and wherein the water diversion structure comprises either a mechanical or electronic flow recorder which records the amount of flow diverted from the waterway;

increasing the flow of water through the waterway by a replacement water structure which conveys additional, non-native to the waterway, imported replenishing water wherein replacement water structure comprises either a mechanical or electronic flow recorder to record the amount of flow added to the waterway; wherein the replacement water structure is located downstream from the at least one water diversion structure located upstream wherein the diverted water is not reintroduced into the waterway; and wherein the output volume of water flow immediately downstream to the replacement water structure remains constant.

2. The flow quantity equalization method as in claim 1, wherein reducing the flow of water through the waterway by said at least one man-made water diversion structure comprises opening a valve to divert flow from the waterway.

3. The flow quantity equalization method as in claim 2, wherein said valve incorporates said flow recorder.

4. The flow quantity equalization method as in claim 1, wherein said replacement water structure located downstream of the at least one man-made water diversion structure is further located upstream of a last man-made water diversion structure on the waterway.

5. The flow quantity equalization method as in claim 4, wherein increasing the flow of water through said waterway by said replacement water man-made diversion structure comprises opening a valve to add flow in said waterway.

6. The flow quantity equalization method as in claim 5, wherein said valve incorporates said flow recorder.

7. The flow quantity equalization method as in claim 1, wherein a part of said waterway comprises a natural waterway.

8. The flow quantity equalization method as in claim 1, wherein said at least one man-made water diversion structures and said replacement water structure comprise valves operated by either telemetry or electrical-mechanical mechanisms.

* * * * *